US006812629B2

(12) United States Patent
Song et al.

(10) Patent No.: US 6,812,629 B2
(45) Date of Patent: Nov. 2, 2004

(54) SHADOW MASK FRAME ASSEMBLY FOR FLAT CRT WITH SLOT GROUPS

(75) Inventors: Gi-young Song, Suwon (KR); Do-hun Pyun, Yongin (KR)

(73) Assignee: Samsung SDI Co., Ltd., Suwon-si (KR)

( * ) Notice: Subject to any disclaimer, the term of this patent is extended or adjusted under 35 U.S.C. 154(b) by 30 days.

(21) Appl. No.: 09/733,067

(22) Filed: Dec. 11, 2000

(65) Prior Publication Data

US 2001/0004186 A1 Jun. 21, 2001

(30) Foreign Application Priority Data

Dec. 10, 1999 (KR) ..... 1999-56747

(51) Int. Cl.[7] ..... H01J 29/80
(52) U.S. Cl. ..... 313/407; 313/402
(58) Field of Search ..... 313/402, 403, 313/404, 407, 408

(56) References Cited

U.S. PATENT DOCUMENTS

| | | | | |
|---|---|---|---|---|
| 3,652,895 | A | | 3/1972 | Tsuneta et al. |
| 4,168,450 | A | | 9/1979 | Yamauchi et al. |
| 4,300,069 | A | | 11/1981 | Nolan |
| 4,678,963 | A | | 7/1987 | Fonda |
| 4,794,299 | A | | 12/1988 | Chiodi et al. |
| 4,915,658 | A | | 4/1990 | Lopata et al. |
| 4,942,332 | A | | 7/1990 | Adler et al. |
| 4,973,283 | A | | 11/1990 | Adler et al. |
| 5,030,880 | A | | 7/1991 | An |
| 5,355,049 | A | | 10/1994 | Sung |
| 5,523,647 | A | | 6/1996 | Kawamura et al. |
| 5,856,725 | A | | 1/1999 | Ueda |
| 5,877,586 | A | | 3/1999 | Aibara |
| 5,898,259 | A | | 4/1999 | Reyal |
| 6,013,400 | A | * | 1/2000 | LaPeruta et al. ..... 430/24 |
| 6,057,640 | A | | 5/2000 | Aibara |
| 6,140,754 | A | | 10/2000 | Ko |
| 6,335,594 | B2 | * | 1/2002 | Park ..... 315/1 |
| 6,469,431 | B1 | * | 10/2002 | Suzuki et al. ..... 313/407 |
| 6,605,890 | B1 | * | 8/2003 | Tanabe et al. ..... 313/403 |
| 2001/0020817 | A1 | * | 9/2001 | Inoue et al. ..... 313/461 |
| 2001/0033130 | A1 | * | 10/2001 | Ha et al. ..... 313/407 |
| 2002/0014822 | A1 | * | 2/2002 | Shin et al. ..... 313/408 |

FOREIGN PATENT DOCUMENTS

| | | | |
|---|---|---|---|
| JP | 2-186536 | * | 7/1990 |
| JP | 4-277448 | * | 10/1992 |
| JP | 7-230772 | * | 8/1995 |
| JP | 11-16511 | * | 1/1999 |
| KR | 9309359 | * | 9/1993 |

* cited by examiner

*Primary Examiner*—Jay Patidar
(74) *Attorney, Agent, or Firm*—Robert E. Bushnell, Esq.

(57) ABSTRACT

A shadow mask frame assembly of a flat cathode ray tube (CRT) includes a shadow mask including a plurality of strips formed at a main body in a vertical direction by being separated a predetermined distance by slits and a plurality of bridges forming slots by connecting neighboring strips and sectioning the slits, in which the slots include a first slot group including slots having a wide interval between the bridges and a second slot group including slots having a narrow interval between the bridges, first and second support members secured at a long side portion of the shadow mask, and a frame including first and second elastic members, either end portion of each of which is secured to each of the first and second support members, for applying a tension force to the shadow mask.

31 Claims, 6 Drawing Sheets

SHADOW MASK FRAME ASSEMBLY FOR FLAT CRT WITH SLOT GROUPS

CLAIM OF PRIORITY

This application makes reference to, incorporates the same herein, and claims all benefits accruing under 35 U.S.C. §119 from an application entitled *Shadow Mask Frame Assembly for the Flat CRT* earlier filed in the Korean Industrial Property Office on 10 Dec. 1999, and there duly assigned Ser. No. 99-56747 by that Office.

BACKGROUND OF THE INVENTION

1. Field of the Invention

The present invention relates to a flat CRT (cathode ray tube), and more particularly, to a shadow mask of a flat CRT.

2. Description of the Background Art

A color CRT includes a shadow mask frame assembly which is installed in a panel where a fluorescent film is formed and a funnel coupled to the panel forming a seal. The funnel includes a neck portion in which an electron gun is inserted and a cone portion around which a deflection yoke is installed. In the color CRT having the above structure, an electron beam emitted from the electron gun passes through an electron beam passing hole of a shadow mask and lands on a fluorescent substance of a surface of a screen of the panel, forming an image.

A surface of a screen of a typical color CRT is designed to have a predetermined curvature considering the trace of the electron beam emitted from the electron gun. The shadow mask is designed to have a curvature corresponding to that of the surface of the screen. However, the curved shadow mask bulges toward the panel by being heated by the electron beam emitted from the electron gun, which is referred to as a doming phenomenon. The doming phenomenon prevents the electron beam from accurately landing on a fluorescent surface.

A flat CRT has recently been developed to provide a flat screen. Since the panel of the flat CRT is flat, the shadow mask installed in the CRT should be flat. In order to realize flatness, a tension force is applied to the shadow mask of the flat CRT.

A shadow mask frame assembly includes a frame having two support members installed parallel to each other and two elastic members, either end portion of each of which is secured at each of the support members, and a flat shadow mask having an edge portion that is welded to the support members. In the shadow mask, a plurality of strips are connected by a plurality of bridges.

In the shadow mask frame assembly, since the flat shadow mask is supported in the state of receiving a great tension force provided by the elastic members through the support members, the flat shadow mask receives a Poisson contraction. During the operation of a CRT, thermions emitted from the electron gun partially pass through slots of the shadow mask while the remaining thermions collide against the strips and the bridges to heat and expand the shadow mask. The amount of deformation due to the thermal expansion increases from the center of the shadow mask to the periphery of the shadow mask due to the bridges.

Accordingly, the shadow mask is deformed due to a combination of the Poisson contraction and thermal expansion. Furthermore, as the bridges uniformly formed at the front surface of the shadow mask interferes with deformation of the strips, an unbalanced tension force is generated at each portion of the shadow mask and the amount of deformation at each portion is different. In particular, deformation occurs greater at the central portion between both ends in a horizontal direction. Such deformation of the shadow mask prevents the thermions emitted from the electron gun from accurately landing on the fluorescent film. Therefore, the color purity of a displayed image is lowered.

Exemplars of the art are U.S. Pat. No. 5,355,049 issued to Sung for ASSEMBLY OF SHADOW MASK FRAME WITH INNER SHIELD FOR COLOR CATHODE RAY TUBE, U.S. Pat. No. 5,898,259 issued to Reyal for SHADOW MASK FRAME OF A CATHODE RAY TUBE, ITS PROCESS OF MANUFACTURE, AND SUSPENSION ELEMENT OF A SHADOW MASK FRAME, U.S. Pat. No. 4,678,963 issued to Fonda for SHADOW MASK FOR A COLORED IMAGE TUBE AND IMAGE TUBE COMPRISING THE SAME, U.S. Pat. No. 5,877,586 issued to Aibara for SLOT-TYPE SHADOW MASK, U.S. Pat. No. 5,030,880 issued to An for SHADOW MASK FOR COLOR CATHODE RAY TUBE, U.S. Pat. No. 3,652,895 issued to Tsuneta et al. for SHADOW-MASK HAVING GRADUATED RECTANGULAR APERTURES, U.S. Pat. No. 5,856,725 issued to Ueda for SHADOW MASK WITH EDGE SLOTS CONFIGURATION, U.S. Pat. No. 4,168,450 issued to Yamauchi et al. for SLOT TYPE SHADOW MASK, U.S. Pat. No. 4,300,069 issued to Nolan for COLOR PICTURE TUBE HAVING IMPROVED SLIT TYPE SHADOW MASK AND METHOD OF MAKING SAME, U.S. Pat. No. 4,973,283 issued to Alder et al. for METHOD OF MANUFACTURING A TIED SLIT MASK CRT, U.S. Pat. No. 4,942,332 issued to Alder et al. for TIED SLIT MASK FOR CATHODE RAY TUBES, U.S. Pat. No. 5,523,647 issued to Kawamura et al. for COLOR CATHODE RAY TUBE HAVING IMPROVED SLOT TYPE SHADOW MASK, U.S. Pat. No. 6,057,640 issued to Aibara for SHADOW MASK FOR COLOR CATHODE RAY TUBE WITH SLOTS SIZED TO IMPROVE MECHANICAL STRENGTH AND BRIGHTNESS, U.S. Pat. No. 6,140,754 issued to Ko for STRUCTURE OF SHADOW MASK FOR FLAT CATHODE RAY TUBE, U.S. Pat. No. 4,794,299 issued to Chiodi et al. for FLAT TENSION MASK COLOR CRT FRONT ASSEMBLY WITH IMPROVED MASK FOR DEGROUPING ERROR COMPENSATION, and U.S. Pat. No. 4,915,658 issued to Lopata et al. for REFERENCE AND SUPPORT SYSTEM FOR FLAT CRT TENSION MASK. I have found that the background art does not show a shadow mask of a cathode ray tube that reduces Poisson contraction and is stable to external impacts.

SUMMARY OF THE INVENTION

It is therefore, an object of the present invention to provide a shadow mask of a flat cathode ray tube in which Poisson contraction thereof is reduced and is stable to external impacts.

It is another object to have a cathode ray tube that is stable and maintains a high picture clarity.

It is yet another object to have a cathode ray tube that reduces Poisson contraction within a shadow mask by forming a particular pattern within the shadow mask.

It is still yet another object to have a frame of a shadow mask of a display device that adds stability of the display device.

Accordingly, to achieve the above objects, there is provided a shadow mask frame assembly of a flat CRT having a shadow mask including a plurality of strips formed at a main body in a vertical direction by being separated a predetermined distance by slits and a plurality of bridges forming slots by connecting neighboring strips and sectioning the slits, in which the slots include a first slot group including slots having a wide interval between the bridges and a second slot group including slots having a narrow interval between the bridges, first and second support members secured at a long side portion of the shadow mask, and a frame including first and second elastic members, either end portion of each of which is secured to each of the first and second support members, for applying a tension force to the shadow mask.

It is preferred in the present invention that at least two second slot groups are formed at upper and lower portions of the shadow mask in a vertical direction while the first slot group is formed between the two second slot groups in the vertical direction. The first slot group is formed at the central portion of the main body in the vertical direction. The number of the slots forming the first slot group in the vertical direction is one. The number of the slots forming the second slot group in the vertical direction is at least three. The length of each of the slots forming the second slot group is substantially the same. The length of each of the second slot groups in the vertical direction and the length of the first slot group in the vertical direction are substantially the same. The length of the second slot group in the vertical direction is substantially the same as the length of the first slot group in the vertical direction.

To achieve another aspect of the above object, there is provided a shadow mask frame assembly of a flat CRT having a shadow mask including a plurality of strips formed at a main body in a vertical direction by being separated a predetermined distance by slits and a plurality of bridges forming slots by connecting neighboring strips and sectioning the slits, in which a portion where the bridges are formed and a portion where the bridges are not formed are alternately disposed in a horizontal direction, first and second support members secured at a long side portion of the shadow mask, and elastic members, either end portion of each of which is secured to each of the first and second support members, for applying a tension force to the shadow mask.

Also, it is preferred in the present invention that the intervals between the bridges in the vertical direction are substantially the same.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
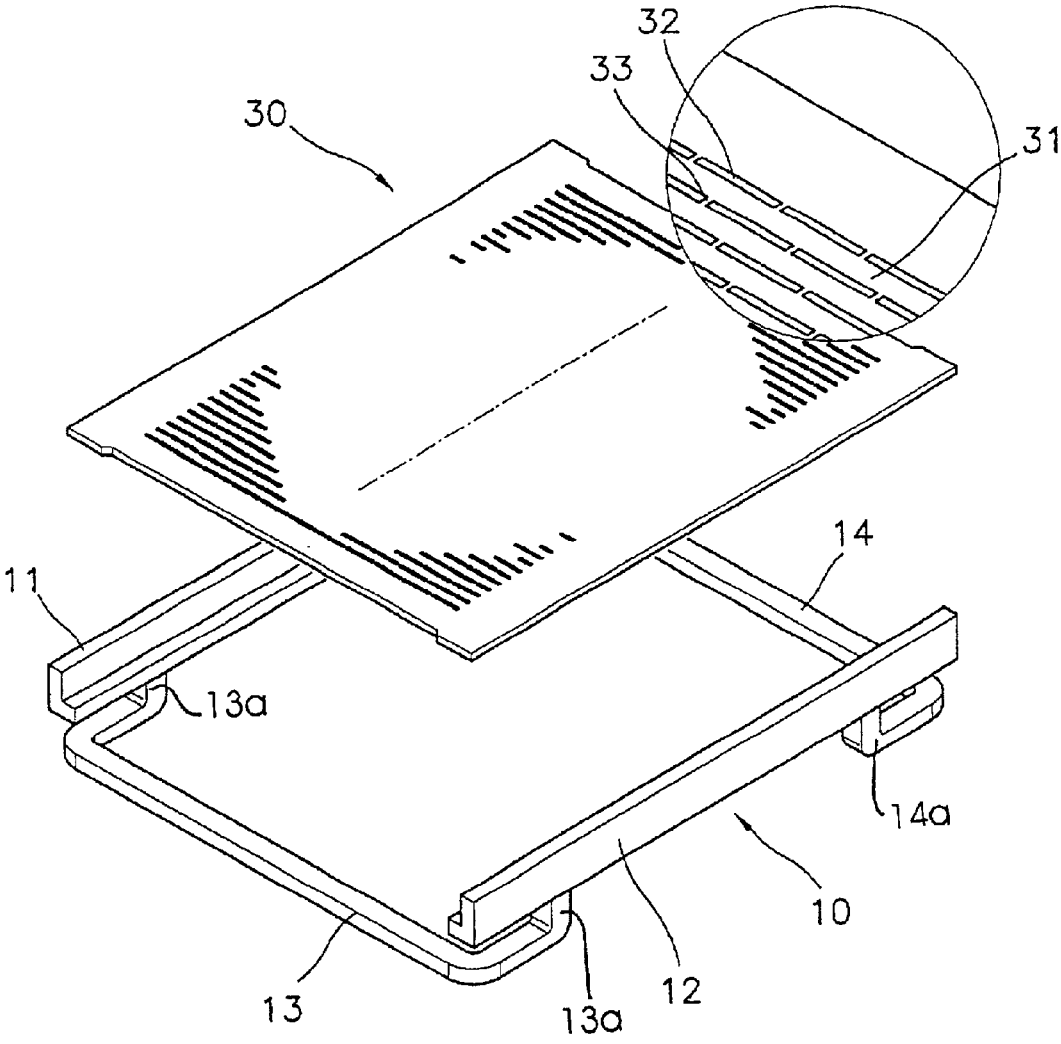
FIG. 1 is a perspective view showing a shadow mask frame assembly of a conventional flat CRT.

FIG. 1 shows a shadow mask frame assembly for a typical flat cathode ray tube. As shown in the drawing, a shadow mask frame assembly includes a frame 10 having two support members 11 and 12 installed parallel to each other, two elastic members 13 and 14 secured to both the support members 11 and 12, and a flat shadow mask 30 having an edge portion welded to the support members 11 and 12. One end portion 13*a* of elastic member 13 is connected to the support member 11 while the other end portion 13*a* is connected to the support member 12. Elastic member 14 similarly has one end portion 14*a* connected to support member 12 while the other end portion is connected to support member 11. In the shadow mask 30, a plurality of strips 31 are connected by a plurality of bridges 33.

In the shadow mask frame assembly, since the flat shadow mask 30 is supported in the state of receiving a great tension force provided by the elastic members 13 and 14 through the support members 11 and 12, the flat shadow mask 30 receives Poisson contraction. During the operation of a CRT (not shown), thermions emitted from the electron gun (not shown) partially pass through slots 32 of the shadow mask 30 while the remaining thermions collide against the strips 31 and the bridges 33 to heat and expand the shadow mask 30. The amount of deformation due to the thermal expansion increases from the center of the shadow mask 30 to the periphery of the shadow mask 30 due to the bridges 33.

Accordingly, the shadow mask 30 is deformed due to a combination of the Poisson contraction and thermal expansion. Furthermore, as the bridges 33 uniformly formed at the front surface of the shadow mask 30 interferes with deformation of the strips 31, unbalanced tension force is generated at each portion of the shadow mask 30 and the amount of deformation at each portion is different. In particular, deformation occurs greater at the central portion between both ends in a horizontal direction. Such deformation of the shadow mask prevents the thermions emitted from the electron gun from accurately landing on the fluorescent film. Therefore, color purity of a displayed image is lowered.

Figure 2A:
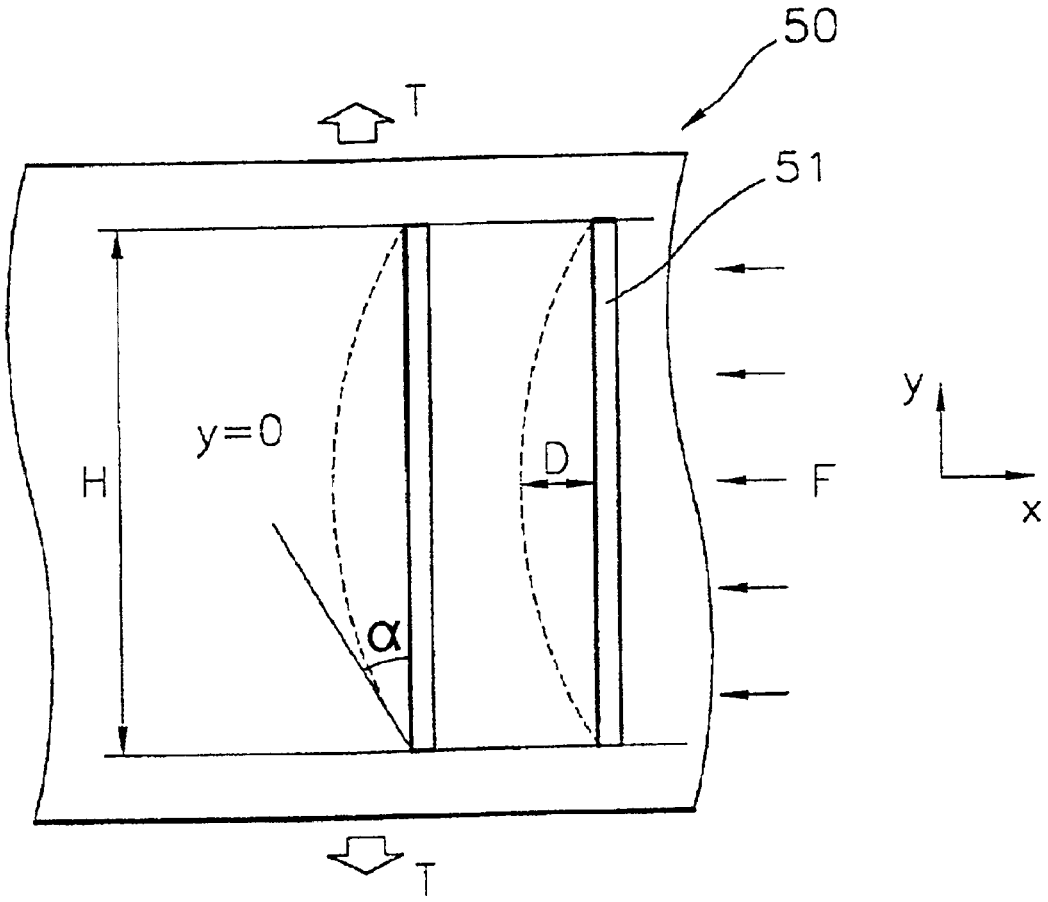
FIGS. 2A through 2C are a plan view and partially enlarged views for explaining Poisson contraction generated by a tension force at a shadow mask frame assembly for a CRT.

FIG. 2A shows a shadow mask 50 where bridges are not formed, in which Poisson contraction is generated in the state in which a predetermined tension force T is applied. Referring to FIG. 2A, when a predetermined tension force T is applied to the shadow mask 50, a lateral force F by the Poisson contraction is considered. Here, it is assumed that a strip 51 deforms very little, the deformation forms a parabola, the inclination at a point where the strip 51 begins to deform is $\alpha$, a direction in which the tension force T acts is a y direction, a direction in which the lateral force F acts is an x direction, the height of an overall effective screen of the shadow mask 50 is H, and the maximum deformation at the central portion in the x direction is D. $\beta_1$, $\beta_2$ and $\beta_3$ signify arbitrary constants. Hereinafter, it is assumed that a direction in which the tension force T acts is a vertical direction. A lateral force F acts in a direction perpendicular to the direction in which the tension force T acts. The lateral force F acts in a horizontal direction.

When the deformation is very little, $\alpha \approx F/(2T)$. When the deformation is parabolic, $y^2=\beta_1 \cdot x$. Thus, $H^2/4=\beta_1 \cdot D$. Since $\alpha$ signifies inclination when $y=H/2$, $\tan\alpha=dD/dH=H/\beta_1$ by different Thus, the stiffness of the strip 51 is $F/D=F/(H^2/\beta_2)=(\beta_2 HT)/(H^2)=(\beta_2 T)/H$. Here, it can be the stiffness increases as H decreases and increases as a value T increases so that deformation at the central position between both end portions in a horizontal direction becomes the greatest. However, in the case of the shadow mask 50 in which the strips 51 are not connected by bridges, when an external impact such as collision of thermions is applied, the strips 51 vibrate. To prevent the vibration, a wire crossing the strips 51 can be installed. However, since the shadow mask 50 needs to have a predetermined curvature in a long side's direction (x direction), realization of complete flatness is not possible. Thus, it is preferable that bridges connecting the neighboring strips 51 are adopted.

Figure 2B:
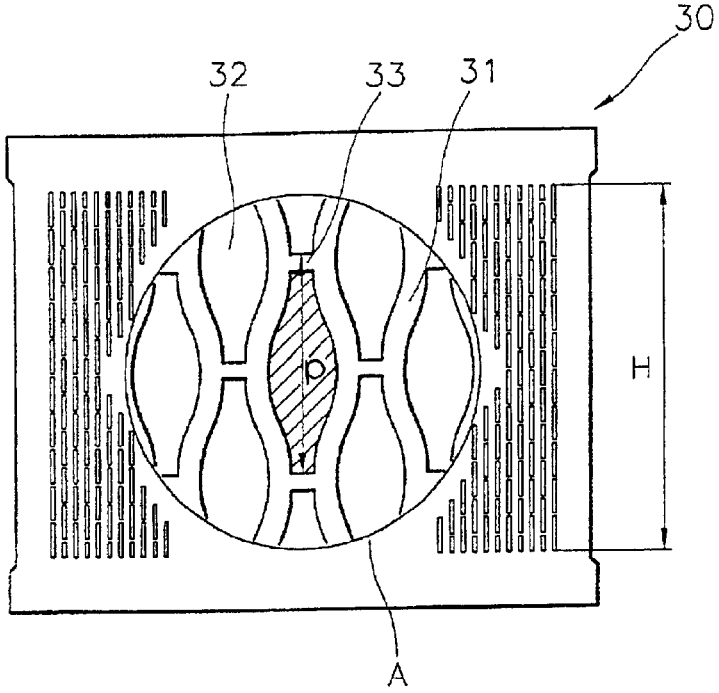
Figure 2C:
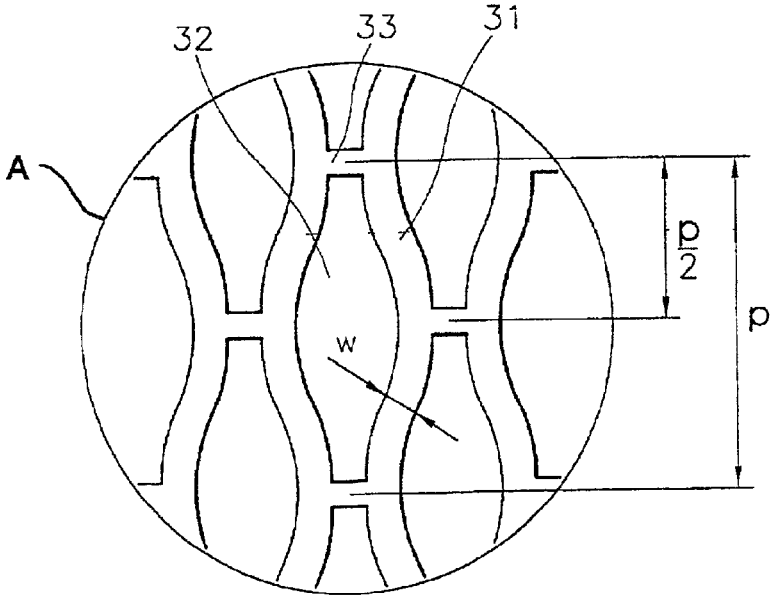

FIGS. 2B and 2C show a shadow mask where bridges 33 for connecting the strips 31 as shown in FIG. 2A are further formed. When the shadow mask 30 further having the bridges 33 is attached to a frame while receiving a predetermined tension force, Poisson contraction is generated which can be seen in an enlarged portion A of FIG. 2B and FIG. 2C. Here, it is assumed that the pitch of each of the bridges 33 is p, the thickness of the shadow mask 30 is t and the width of each of the strips 31 is w, the elastic modulus is E, and the effective height of the overall screen of the shadow mask is H.

As shown in the drawings, since the stiffness due to elastic deformation is symmetrical, only ½ pitch is considered. One side which is connected by the bridge 33 can be considered as a matter of a secured cantilever. Here, in the cantilever having p/2 length which is considered as a cantilever, stiffness is $(8tw^3E)/p^3$. Since there are H/(p/2) units of a portion as long as p/2 in the height H of the overall effective screen, the overall stiffness is $((8tw^3E)/p^3)\times(2H/p)=(16tw^3EH)/p^4$. Therefore, the stiffness is inversely proportional to $p^4$ so that, as p increases or the number of the bridges 33 is reduced, stiffness decreases. Here, reference numeral 32 denotes a slot formed by the bridges 33 connecting the strips 31.

As described with reference to FIGS. 2A through 2C, each of the bridges 33 is an elastic member serving as a spring and connects and confines neighboring strips 31. Thus, when the shadow mask 30 is secured to a frame while receiving a predetermined tension force, deformation is generated most greatly at the central position of the shadow mask 30. Also, since stiffness is reduced as the pitch p increases or the number of the bridges 33 decreases, Poisson contraction is reduced using these facts. That is, the arrangement of the bridges are adjusted to compensate for a change in stiffness of the strips due to a change in pitch p of the bridges and a change in tension force due to connection of the bridges and the strips.

Figure 3:
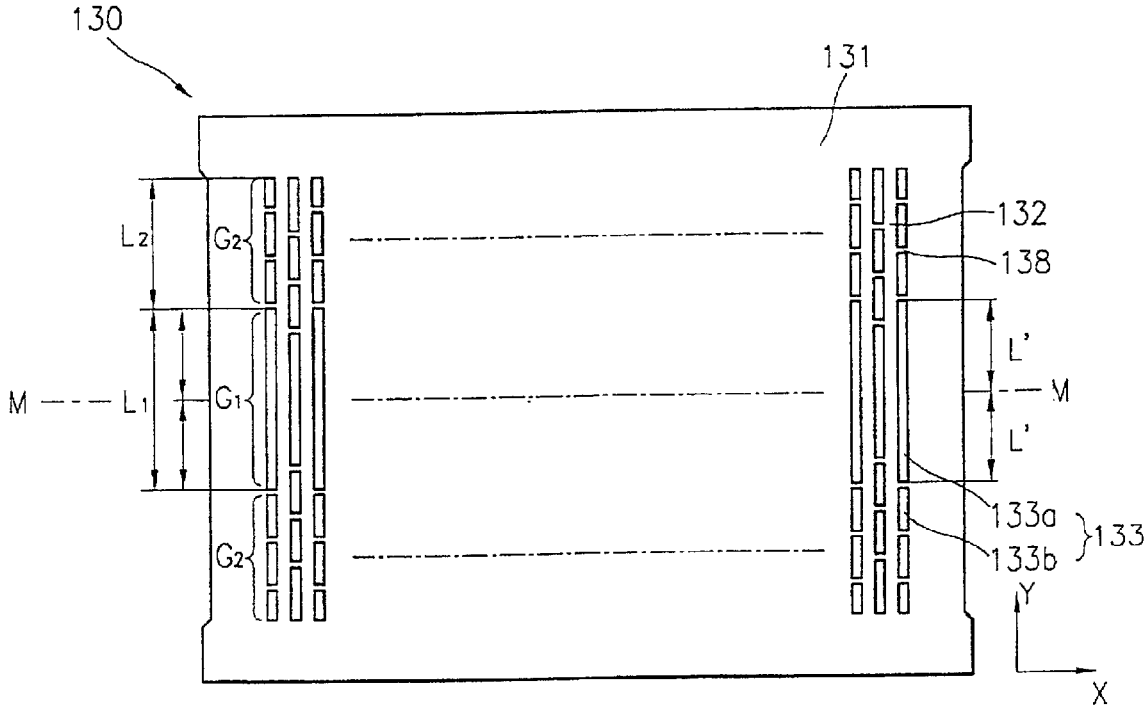
FIGS. 3 through 5 are plan views showing shadow mask assemblies according to different preferred embodiments of the present invention.
Figure 4A:
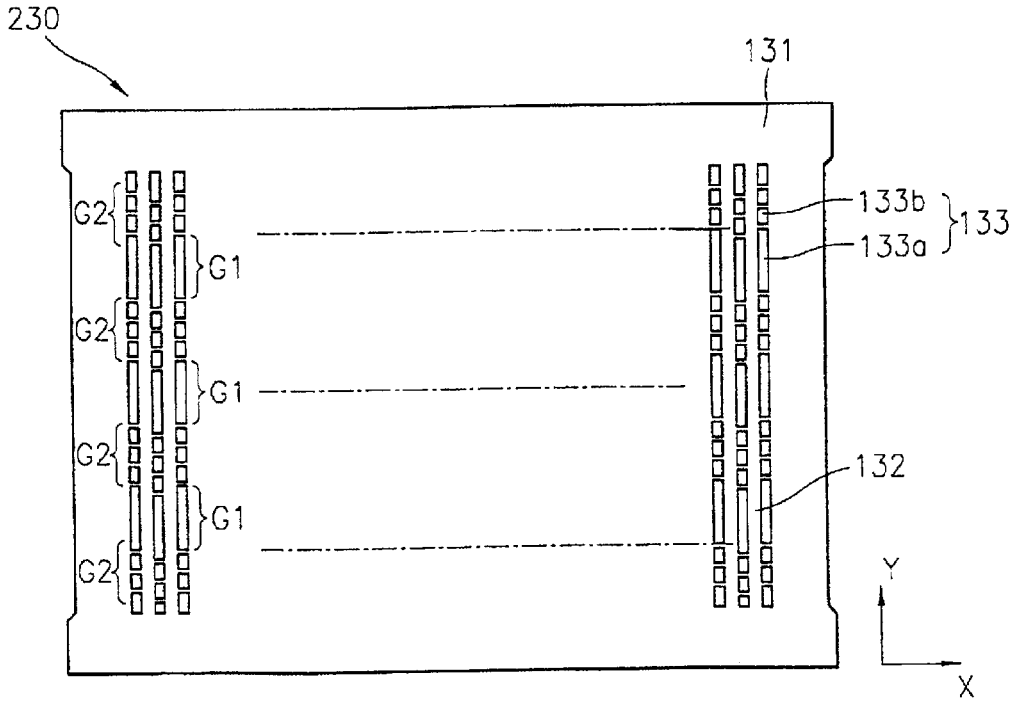
Figure 4B:
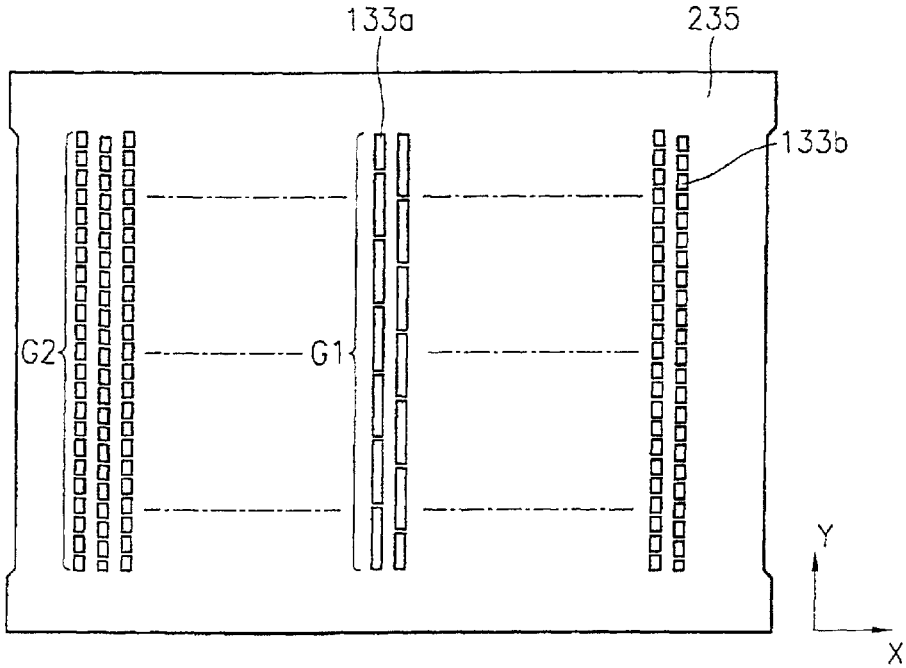
Figure 5:
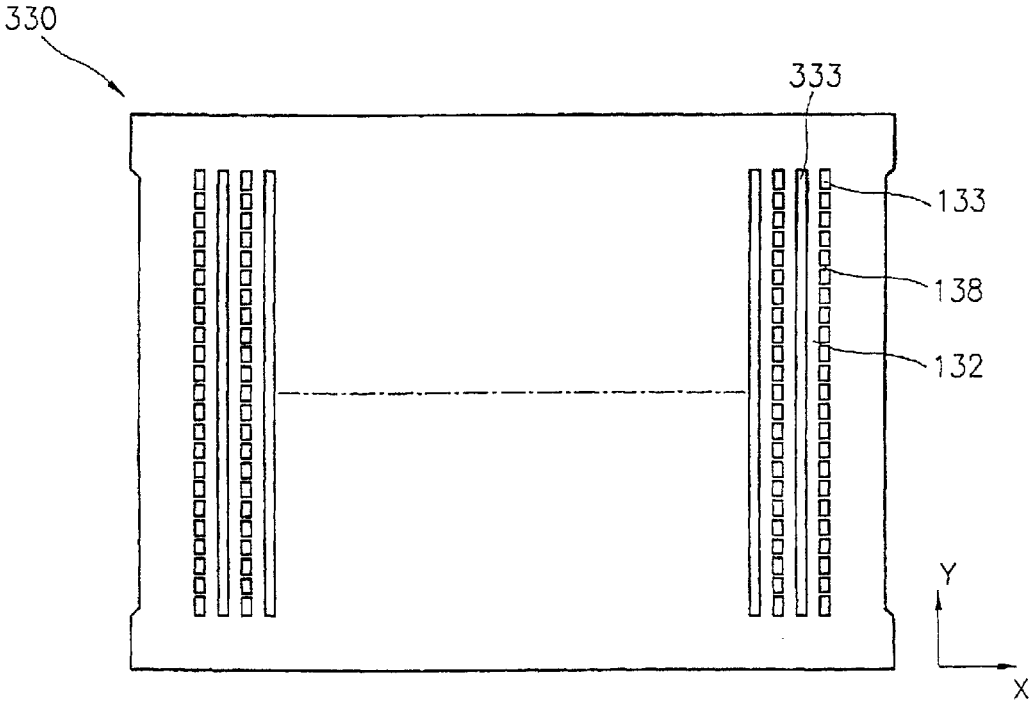

FIGS. 3 through 5 show shadow mask frame assemblies of CRTs according to different preferred embodiments of the present invention. These drawings are plan views showing arrangements of bridges formed at the shadow mask according to each of the preferred embodiments. Here, the same reference numerals denote the same structural elements.

Referring to FIG. 3, a shadow mask 130 includes a main body 131. The main body 131 includes a plurality of strips 132 formed by being separated from one another by slits in a vertical direction (Y direction) and a plurality of bridges 138 connecting neighboring strips 132. Here, the slits form the slots 133 by being separated by the bridges 138.

The slots 133 are formed as passing holes through which an electron beam emitted from an electron gun (not shown) passes. The neighboring slots 133 are separated by a predetermined distance. The slots are formed corresponding to a fluorescent pattern of red, green and blue of a fluorescent film.

The slots are formed by groups. That is, there is a first slot group GI formed of slots 133*a* in which the distance between the bridges 138 is wide in the Y direction and second slot groups G2 each of which is formed of slots 133*b* in which the distance between the bridges 138 is narrower than that of the first slot group G1.

The second slot groups G2 can be formed at the upper and lower portions of the screen in the vertical direction. The first slot group G1 can be formed between the second slot groups G2 in the vertical direction.

As shown in the drawings, the first slot group G1 is formed at the central portion of the main body 131 in the vertical direction while each of the second slot groups G2 is formed at either upper or lower portion of the first slot group G1 in the vertical direction. The number of the slots 133*a* forming the first slot group G1 in the vertical direction is one while the number of the slots 133*b* forming each of the second slot groups G2 is one or more, preferably at least three. The length of the slot 133*b* forming each of the second slot groups G2 in the vertical direction is formed uniformly. Here, as a method of adjusting the distance between the bridges 138, the length of each of the slots 133*b* of the second slot groups G2 in the vertical direction and the length L1 of the slots 133*a* of the first slot group G1 in the vertical direction are substantially formed to be identical, or the sum L2 of the lengths of the slots 133*b* of the second slot groups G2 is substantially the same as the length L1 of the slots 133*a* of the first slot group G1.

The bridges 138 of each of the strips 132 are formed at identical intervals from a point separated a predetermined length L' from the center line M—M. The pitch of or interval between the bridges 138 is formed to be longer at the central portion so that the length of the slots 133 is great. At the periphery such as the upper and lower portions, the interval between the bridges 138 are formed to be relatively narrower so that the length of the slots 133 is small. In such arrangement of the bridges 138, since the pitch of or interval between the bridges 138 at the periphery of the upper and lower portions is formed to be relatively narrower, stiffness of the strips 132 increases. Also, since large number of the bridges 138 are formed at the periphery, interference between the strips 132 and the bridges 138 is generated and thus less tension force is generated at the central portion.

Thus, the central portion can be applied by a relatively less tension force than that in the periphery so that the shadow mask can be attached to a frame with less tension force. Also, since the interference by the bridge 138 decreases at the central portion, Poisson contraction is reduced. Here, the predetermined length L' is determined by the relationship to the amount of the tension force applied to the shadow mask 130 and to the size of a panel (not shown) of the CRT.

Referring to FIG. 4A, which is basically the same as FIG. 3, a plurality of second slot groups G2 and a plurality of first slot groups G1 are alternately formed in the vertical direction.

Referring to FIG. 4B, it can be seen that the first slot group G1 of shadow mask 235 is formed at the middle portion in the horizontal direction while the second slot group G2 is formed at the peripheries at both sides in the horizontal direction.

Referring to FIG. 5, both a portion where the bridges 138 are formed and a portion where the bridges 138 are not formed are alternately formed in the vertical direction. That is, a plurality of bridges 138 are formed at only one slot among two neighboring slits in the horizontal direction to form the slots 133 whereas no bridges are formed at the other slit 333. Here, the interval of the bridges 138 in the vertical direction may be formed to be substantially the same.

The number of the bridges 138 formed at the shadow masks 130,230,235, and 330 as shown in FIGS. 3 through 5 can be adjusted considering the length of each of the slots 133 and an interval maintaining state between the strips 132. Also, the width of each of the bridges 138 is formed such that a latent image cannot be displayed when an electron beam emitted from an electron gun (not shown) passes through the adjacent slots 133 sectioned by the bridges 138 and lands on a fluorescent film (not shown). The position of the bridges 138 is determined considering a material property, such as material of the shadow mask used for a flat CRT, and a tension force. The strips 132 and the slots 133 can be formed by an etching processing the main body 131 of the shadow mask.

The shadow masks 130, 230, 235, and 330 according to the present invention assembled to the frame makes a shadow frame assembly of a CRT. As the frame, anything which can be used in the field to which the present invention pertains may be used without limit.

Figure 6:
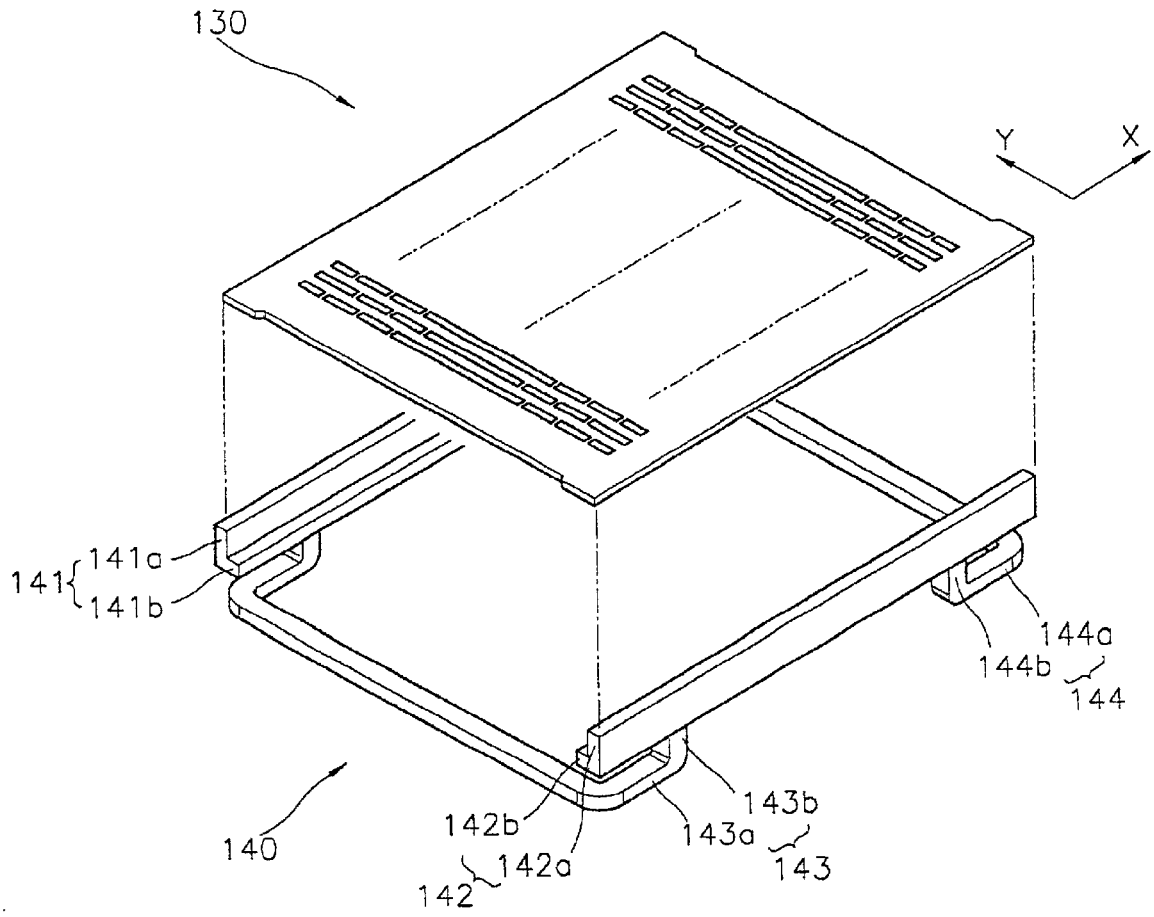
FIG. 6 is an exploded perspective view showing a shadow mask frame assembly according to the present invention of FIG. 3.

In FIG. 6, the shadow mask 130 shown in FIG. 3 is illustrated. However, the shadow masks 230, 235, and 330 shown in FIGS. 4A, 4B, and 5 can be assembled to the frame and descriptions thereof will be omitted. As shown in the drawings, the shadow mask frame assembly includes a frame 140 supporting the shadow mask 130 to receive a predetermined tension force.

The frame 140 includes first and second support members 141 and 142 separated a predetermined distance and first and second elastic members 143 and 144 respectively having both end portions supported at either side end of each of the first and second support members 141 and 142. Here, the first and second support members 141 and 142 include secured portions 141*a* and 142*a* and reinforcement portions 141*b* and 142*b* so that a section of each of the first and second support members 141 and 142 has an L shape. The first and second elastic members 143 and 144 include support members 143*b* and 144*b*, coupled to the support members 141 and 142 by welding, and extended portions 143*a* and 144*a* bent and respectively extending from the end portions 143*b* and 144*b*.

In the process of assembling the shadow mask frame assembly by securing the shadow mask 130 to the frame 140, the first and second support members 141 and 142 coupled to the first and second elastic members 143 and 144 are pressed in directions close to each other and the first and second elastic members 143 and 144 supporting the first and second support members 141 and 142 are elastically deformed. Under these circumstances, the long side portion of the shadow mask 130 is welded to the secured portions 141*a* and 142*a* of the first and second support members 141 and 142. Next, the pressure applied to the first and second support members 141 and 142 is removed in the state in which the elastic members 143 and 144, the support members 141 and 142 and the shadow mask 130 are assembled, so that a tension force is applied to the shadow mask 130 due to an elastic force by the elastic members 143 and 144.

As described above, the shadow mask frame assembly of a CRT according to the present invention has the following effects. When there is an external impact, since the strips are connected by the bridges, generation of vibrations of the strips can be restricted so that the strips can be effectively secured. Also, when the shadow mask is heated and deformed by collision of an electron beam, by appropriately designing pitch of the bridges, a phenomenon that the tension force applied to the strips is partially removed can be prevented. Further, since the bridges are arranged to reduce the interference between the bridges and strips, Poisson contraction is reduced and twist deformation of the strips is reduced. Thus, lowering of color purity due to the deformation of the shadow mask during the operation of a flat CRT is prevented.

It is noted that the present invention is not limited to the preferred embodiment described above, and it is apparent that variations and modifications by those skilled in the art can be effected within the spirit and scope of the present invention defined in the appended claims.

What is claimed is:

1. A shadow mask frame assembly of a flat cathode ray tube, comprising:

a shadow mask including a plurality of strips formed at a main body ina vertical direction by being separated by a predetermined distance by slits and a plurality of bridges forming the slots by connecting neighboring strip and sectioning the slits, the slots including a plurality of first slot groups and second slot groups with the slots, the first slot groups having a wider interval between the bridges than the second slot groups, with at least two columns including at least both said first and second slot groups in each column, the slots partially passing through thermions emitted from an electron gun of said flat cathode ray tube while the remaining thermions colliding against the strips and the bridges; and a frame supporting said shadow mask, said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask.

2. The assembly as claimed in claim 1, with the first slot groups alternating with the second slot groups.

3. A shadow mask frame assembly of a flat cathode ray tube, comprising:

a shadow mask including a plurality of sirips formed at a main body in a vertical direction by being separated by a predetermined distance by slits and a plurality of bridges forming slots by connecting neighboring strips and sectioning the slits, the slots including a first slot group and a second slot group with the slots, the first slot group having a wider interval between the bridges than the second slot group, the slots partially passing through thermions emitted from an electron gun of said flat cathode ray tube while the remaining thermions colliding against the strips and the bridges; and a frame supporting said shadow mask, said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask, with at least one second slot group forming at said upper and lower portions of said shadow mask in a vertical direction while the first slot group is being formed between the two second slot groups in the vertical direction.

4. The assembly as claimed in claim3, with the number of the slots forming the first slot group in the vertical direction being one.

5. The assembly as claimed in claim 4, with the number of the slots forming the second slot group in the vertical direction being at least three.

6. The assembly as claimed in claim 5, with the length of each of the slots forming the second slot group being substantially the same.

7. The assembly as claimed in claim 6, with the length of each of the slots of the second slot groups in the vertical direction and the length of the slots of the first slot group in the vertical direction being substantially the same.

8. The assembly as claimed in claim 6, with the sum of the lengths of the slots of the second slot group in the vertical direction being substantially the same as the length of the slots of the first slot group in the vertical direction.

9. A shadow mask frame assembly of a flat cathode ray tube, comprising:

a shadow mask including a plurality of strips formed at a main body in a vertical direction by being separated by a predetennined distance by slits and a plurality of bridges forming slots by connecting neighboring strips and sectioning the slits, the slots including a first slot group and a second slot group with the slots, the first slot group having a wider interval between the bridges than the second slot group, the slots partially passing through thermions emitted from an electron gun of said flat cathode ray tube while the remaining thermions colliding against the strips and the bridges; and a frame supporting said shadow mask, said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask, with the first slot group being formed at the central portion of the main body in the vertical direction.

10. The assembly as claimed in claim 9, with the number of the slots forming the first slot group in the vertical direction being one.

11. A shadow mask frame assembly of a flat cathode ray tube, comprising:

a shadow mask including a plurality of strips formed at a main body in a vertical direction by being separated by a predetermined distance by slits and a plurality of bridges forming slots by connecting neighboring strips and sectioning the slits, the slots including a first slot group and a second slot group with the slots, the first slot group having a wider interval between the bridges than the second slot group, the slots partially passing through thermions emitted from an electron gun of said flat cathode ray tube while the remaining thermions colliding against the strips and the bridges; and a frame supporting said shadow mask, said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask, with a plurality of the second slot groups and the first slot groups being formed in the vertical direction accommodating each of the first and second groups appearing alternately.

12. A shadow mask frame assembly of a flat cathode ray tube, comprising:

a shadow mask including a plurality of strips formed at a main body in a vertical direction by being separated by a predetermined distance by slits and a plurality of bridges forming slots by connecting neighboring strips and sectioning the slits, the slots including a first slot group and a second slot group with the slots, the first slot group having a wider interval between the bridges than the second slot group, the slots partially passing through thermions emitted from an electron gun of said flat cathode ray tube while the remaining thermions colliding against the strips and the bridges; and a frame supporting said shadow mask, said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask, with the first slot group being formed at the middle portion in the vertical direction and the second slot group being formed at peripheries at both sides of the first slot group.

13. A shadow mask frame assembly of a flat cathode ray tube, comprising:

a shadow mask including a plurality of strips formed at a main body in a vertical direction by being separated a predetermined distance by slits and a plurality of bridges forming slots by connecting neighboring strips and sectioning the slits, a portion of said shadow mask including at least one strip where the bridges separated by the slots are formed and a portion of said shadow mask including at least one strip having at least one slot where the bridges are not formed are alternately disposed in a horizontal direction;

first and second support members secured at a long side portion of said shadow mask; and elastic members having either end portion secured to each of said first and second support members for applying a tension force to said shadow mask.

14. The assembly in as claimed in claim 13, with the intervals between the bridges in the vertical direction being substantially the same.

15. A shadow mask frame assembly, comprising:

a shadow mask, comprising;

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group, with at least one column having both the first slot group and the second slot group; and a frame supporting said shadow mask.

16. The apparatus of claim 15, with said frame comprising:

a first support member and a second support member secured at a long side portion of said shadow mask; and a first elastic member and a second elastic member, said first elastic member and said second elastic member each having two end portions, one of said two end portions coupled to said first support member and the other one of the two end portions coupled to said second support member, said first and second elastic members applying a tension force to said shadow mask.

17. The apparatus of claim 16, with said first and second support members being separated a predetermined distance and said secured portion and said reinforcement portion forming an L shape.

18. The apparatus of claim 15, with the length of the slots of the second slot group being formed uniformly.

19. The apparatus of claim 15, with the width of said bridges being formed to accommodate a latent image not being displayed when the electron beam from the electron gun passes through adjacent slots sectioned by the bridges and lands on a fluorescent film.

20. The apparatus of claim 15, with the bridges positioning on said shadow mask according to the material of said shadow mask and a tension force against said shadow mask.

21. The apparatus of claim 15, with said first and second slot groups being formed with other first and second slot groups and the first and second slot groups being provided alternately along one of the columns.

22. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the first slot group forming at a central portion of said main body of said shadow mask in the vertical direction.

23. The apparatus of claim 22, with the second slot group formed at the upper or lower portion of the main body of said shadow mask.

24. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the number of slots forming the first slot group being one while the number of slots forming the second slot group being at least three.

25. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventingthe passing of electronbeanis from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the length of the first slot group being approximately equal to a length of a slot in the first slot group.

26. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the slots being symmetrically formed with respect a median line cutting across the middle of the columns of slots, said bridges being formed at approximately identical intervals on either side of the median line.

27. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the interval length between bridges at the periphery of upper and lower portions of said shadow mask being less than the interval length between the bridges at the center of said shadow mask accommodating a greater rigidity of the strips.

28. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with a length of the first slot group in the middle of the shadow mask being determined according to the amount of the tension force applied to said shadow mask and to the size of a panel of said cathode ray tube.

29. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, further comprising a plurality of second slot groups and a plurality of first slot groups alternately formed in a vertical direction.

30. A shadow mask frame assembly, comprising:

a shadow masic, comprising:

a plurality of strips forming columns in a vertical direction on a main body of said shadow mask, the strips not passing electron beams emitted from an electron gun of a flat cathode ray tube;

a plurality of slits forming columns and separating the columns of said strips, the plurality of slits passing electron beams emitted from said electron gun of said flat cathode ray tube; and a plurality of bridges sectioning the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with the first slot group being formed in the middle portion of the shadow mask in a horizontal direction while the second slot group is formed at the peripheries at both sides of said shadow mask in the horizontal direction.

31. A shadow mask frame assembly, comprising:

a shadow mask, comprising:

a plurality of strips forming columns in a vertical direction on a main body of said shadow mask, the strips not passing electron beams emitted from an electron gun of a flat cathode ray tube;

a plurality of slits fonning columns and separating the columns of said strips, the plurality of slits passing electron beams emitted from said electron gun of said flat cathode ray tube; and a plurality of bridges sectioning at least one of the columns of the plurality of slits, said bridges preventing the passing of electron beams from said flat cathode ray tube through said shadow mask, said plurality of bridges forming slots by connecting adjacent strips and sectioning the slits, said slots arranged in columns in the vertical direction, the slots being arranged in a first slot group and a second slot group, the first slot group having slots with a wider interval between bridges than the second slot group; and a frame supporting said shadow mask, with columns of said slits having bridges alternating with columns of a single slit with no bridges on said shadow mask.

* * * * *